US007424803B2

(12) United States Patent
Voss

(10) Patent No.: US 7,424,803 B2
(45) Date of Patent: Sep. 16, 2008

(54) METHOD AND DEVICE FOR PRESSURE AMPLIFICATION IN CYLINDERS, IN PARTICULAR HYDRAULIC RAMS

(76) Inventor: Wolfgang Voss, Heinrich-Lübke-Strasse 13A, Schwerte (DE) 58239

( * ) Notice: Subject to any disclaimer, the term of this patent is extended or adjusted under 35 U.S.C. 154(b) by 261 days.

(21) Appl. No.: 10/545,818

(22) PCT Filed: Feb. 6, 2004

(86) PCT No.: PCT/DE2004/000207

§ 371 (c)(1),
(2), (4) Date: Feb. 1, 2006

(87) PCT Pub. No.: WO2004/072486

PCT Pub. Date: Aug. 26, 2004

(65) Prior Publication Data

US 2006/0207251 A1 Sep. 21, 2006

(30) Foreign Application Priority Data

Feb. 14, 2003 (DE) ..... 103 06 128

(51) Int. Cl.
*F15B 11/00* (2006.01)
*B30B 15/16* (2006.01)

(52) U.S. Cl. ..... 60/563; 60/585

(58) Field of Classification Search ..... 60/563, 60/565, 585
See application file for complete search history.

(56) References Cited

U.S. PATENT DOCUMENTS

| | | | | |
|---|---|---|---|---|
| 2,945,353 A * | 7/1960 | Glas | 60/565 |
| 2,990,687 A * | 7/1961 | McCrea | 60/563 |
| 2,994,301 A * | 8/1961 | Kirsch | 60/583 |
| 4,288,987 A | 9/1981 | Grullmeier | |
| 4,620,419 A * | 11/1986 | Simson | 60/563 |

FOREIGN PATENT DOCUMENTS

| | | |
|---|---|---|
| DE | 2230492 | 1/1974 |
| JP | 04/157206 | 5/1992 |

* cited by examiner

*Primary Examiner*—Thomas E Lazo
(74) *Attorney, Agent, or Firm*—James Creighton Wray; Clifford D. Hyra

(57) ABSTRACT

A method and corresponding cylinder for pressure amplification in cylinders are disclosed. A second pressurizing piston with a small piston rod is arranged within the cylinder, in other words, within the cylinder housing, by means of which the piston surface cavity in the vicinity of the piston or the pressure medium present there can be further compressed. It is thus possible to increase the stroke displacement where required or to increase the pressure within the cylinder. Further advantages can also be achieved with the above.

13 Claims, 2 Drawing Sheets

METHOD AND DEVICE FOR PRESSURE AMPLIFICATION IN CYLINDERS, IN PARTICULAR HYDRAULIC RAMS

This application claims the benefit of German Application No. 103 06 128.2 filed Feb. 14, 2003 and PCT/DE2004/000207, which are hereby incorporated by reference in their entirety.

BACKGROUND OF THE INVENTION.

The invention relates to a method for increasing pressure in cylinders used for oil hydraulic, water hydraulic, emulsion hydraulic as well as plasma and other fluid hydraulic systems, in which two part or multi-part cylinders are moved apart or together in a controlled fashion by means of valves, and the introduced pressure transducer, which has passed a high pressure pump, whereby in the piston surface cavity beneath the respective piston a specified pressure, even after separation from one another, is generated and maintained through compression of the piston surface cavity. The invention moreover relates to a cylinder for performing the method, comprising a foundation with cylinder housing, the body being connected to a high pressure pump via a supply line, as well as a piston/piston rod displaceable therein and the piston surface cavity formed beneath the piston between the cylinder cover and piston, piston rod and cylinder housing, as well as a compressor that can be inserted in the piston surface cavity.

When actuating cylinders and similar devices, the movement is created by feeding a pressure-transmitting agent, involving oil, water, water in an oil emulsion, plasma or other fluids or also air. By hydraulics is meant the theory and technical application of flows in compressible fluids. This means that in hydraulic systems, the fluid, above all oil or also water in an oil emulsion, initially must be appropriately acted upon in a high pressure pump, i.e. it is prestressed, and is then supplied to the cylinder via hoses or similar lines. The extension and the retraction of the cylinders is controlled by means of valves, always occurring at one and the same pressure level, namely the pressure level that is dependent upon the output of the high pressure pump. Especially in underground mining, where water in an oil emulsion is used for safety reasons, at present 400 bar max. is used, simply because currently no pumps are available which are able to generate a higher pressure level. Due to various circumstances, however, it is not always guaranteed that the afore-mentioned pressure is available in the piston surface cavity, so so-called adjustment circuits are known in underground mining and tunnel construction which allow the volume in the piston surface cavity to be adjusted through re-connection to the high pressure pump such that the above-mentioned pressure level is approximately available. It is not possible, however, to generate a higher pressure level within the piston surface cavity and hence within the cylinder because, as said before, said pumps are not in a position to do so. Yet for various reasons this is frequently desirable, with the pumps in the case of the aforementioned current highest pressure level of 400 bar representing a limit, while in the case of a lower pressure level, the costs of an additional high pressure pump and corresponding hoses would essentially once again compensate for the advantage.

The invention is therefore based on the object of creating a method and a device which enable the operation of cylinders at a randomly increased internal pressure (operating pressure) in relation to the pump pressure.

The object is achieved from a method point of view in that the cylinder is first fed a pressure-transmitting medium (oil, water, emulsion, plasma, compressed air) at a specified pressure level, based on which the cylinder can be displaced, and that thereupon the pressure in the piston surface cavity beneath the piston is increased randomly by using the pressure-transmitting medium having the same pressure level to further compress the pressure-transmitting medium in the piston surface cavity.

SUMMARY OF THE INVENTION.

This method hence makes it possible to increase the pressure level within the piston surface cavity in a specific manner, regardless of the starting point of the pressure level of the pressure transducer, so as to achieve advantages. When for example proceeding from a pressure level that is clearly below 400 bar, the method according to the invention allows the pressure level in the cylinder to be increased in a specific manner without requiring other lines, a cylinder with different dimensions or another pump. Rather the pressure within the cylinder is increased such that the desired maximum pressure level is reached. This way for example in underground mining and tunnel construction, the necessary input pressure in the stamp, i.e. the appropriately designed cylinder, can be achieved without requiring the use of an expensive high pressure pump, which also accordingly requires special lines and valves. Rather, a less expensive and simpler high pressure pump reaching a correspondingly lower pressure level can be used in order to still attain the desired pressure level inside the cylinder or stamp by using the method. Of course it is also possible for the first time to exceed the 400 bar pressure level because with appropriate pressure application on the compressor/tensioning piston this pressure transducer allows a clearly increased pressure level to be generated within the cylinder so as to be able to accomplish the desired objectives. It is possible, for example, to use the invention to achieve a higher pressure in a specific manner or travel a longer path. The cylinders need not be modified. If however as explained above a lower pressure level is assumed, also in the area of the stamp, but especially in the hoses, thinner walls and simpler designs may be used so as to reduce the investment costs. It is now also possible to use the plug-in connections especially popular in underground mining and tunnel construction even when operating at higher end pressures. On the other hand, using hoses with a larger diameter, operation may occur at a lower pressure level in order to achieve the specific amount of pressure transducer fed this way or set it at a very high level.

According to an appropriate embodiment of the invention, it is provided that the pressure-transmitting medium is fed to the cylinder by a 200 bar pump and that the pressure in the piston surface cavity is increased to 300-400 bar or more. This is accomplished with a pressure increase system, which is mentioned up front here and shall be explained further below and allows the pressure level inside the cylinder to be increased correspondingly easily and reliably and as a function of the dimensions.

According to a further development, it is correspondingly provided that the volume of the piston surface cavity is reduced by feeding the pressure-transmitting medium and hence increased compression of the pressure-transmitting medium is generated. The pressure-transmitting medium is accordingly compressed further without the need for introducing pressure-transmitting medium, hence an oil or compressed air, at a higher level. That means that no separate or other pump is required, and accordingly a different system pressure. This has the aforementioned advantages, but additionally also the benefit that it can be implemented easily and without difficulty.

The invention will lead to an increase in the pressure level inside the cylinder, which is accomplished according to the invention in that a piston with smaller dimensions is inserted at the same pressure through the pressure-transmitting medium into the piston surface cavity, compressing the pressure-transmitting medium located there. This increases the pressure level tremendously and in a manner as is required for the respective application.

Depending on the area of application, the invention provides according to its method that the pressure-transmitting medium having the same pressure level is connected as a function of other switch processes or separately so as to keep the possibly required switch complexity as low as possible.

Again, depending on the case and area of application, the invention makes it possible that the pressure-transmitting medium having the same pressure level is connected in series or parallel, which is enabled among other things in that no second system pressure exists and is not required for increasing the pressure or the pressure level in a specific manner beneath the piston.

A cylinder is provided for implementing the method, which has a cylinder housing and the piston displaceable therein with a piston rod, wherein the piston surface cavity is formed beneath the piston, in which the hydraulic fluid or pressure-transmitting medium is fed so as to achieve the displacement of the cylinder. A variable pressure level inside the piston surface cavity is achieved in that the piston surface cavity, specifically the pressure-transmitting medium located therein, is designed such that it can be influenced using the same high-pressure pump directly via an input valve and additionally indirectly via a compressor. It has already been mentioned above that the compressor is a pressure increase system, which hence ensures that the higher pressure in the piston surface cavity is in fact achievable, even if the pressure-transmitting medium required or used for this has a correspondingly lower pressure level. A specific change in the pressure level inside the piston surface cavity is made possible for the first time with the invention described, above all of course to increase it, in particular to above the value enabled by the present high-pressure pumps.

An appropriate embodiment of the invention is that in which the piston surface cavity is designed as boreholes incorporated in the cylinder cover, piston and piston rod, wherein the borehole in the piston rod is expanded so as to accommodate a bushing in which the tensioning piston with a small piston rod (which corresponds to the borehole) is arranged displaceably, and can be connected on the head side to the same high-pressure pump by means of a connecting valve. Already the enumeration of the individual parts of the pressure increase makes it clear that here a solution is provided, which leads to a goal that was previously not even considered in an astonishingly simple manner. Without changing the pressure level of the employed high-pressure pump it is possible to increase the pressure level within the piston surface cavity, i.e. within the cylinder, such that additional functions can be fulfilled, without requiring changes to the device.

The piston surface cavity is for one connected directly to the high pressure pump and secondly indirectly, whereby it is provided that the piston surface cavity can be connected directly to the high pressure pump via the input valve arranged on the head side of the piston. With respect to underground use in a figurative sense, the input valve is therefore located in the base region of the stamp or the cylinder so that the piston with the piston rod can be safely moved out when the connection to the high pressure pump has been established because then the piston is experiencing pressure across an accordingly large surface.

The tensioning piston, which is arranged displaceably inside the cylinder, is supplied from above with hydraulic fluid, i.e. the pressure transducer—again viewed visually and based on the example of an underground stamp. According to the invention, it is provided that the bushing accommodating the tensioning piston is closed by a rod head, which simultaneously closes the large piston rod, to which connecting boreholes that connect the connecting valve and tensioning piston on the head side are allocated. This rod head is inserted partially into the bushing or the correspondingly large piston rod and fixed there, wherein it is held in this position already due to the fact that it is clamped in place from above and/or pressure is applied from above. The connecting valve hence rises with the rod head, however remains easily accessible at all times, because it projects laterally beyond the rod head or the piston rod. This way, it is ensured that also the additional pressure in the cylinder can be created, using one and the same pressure transducer, in terms of the pressure level. The pressure transducer is conducted to the tensioning piston on the head side via the connecting valve and the connecting boreholes so that said piston can be displaced accordingly, as forced by the specified surfaces. The tensioning piston has appropriate dimensions; it is significantly larger than the piston rod.

The rod head, which closes the bushing at the top and hence also the hollow large piston rod, incidentally ensures that the pressure conditions inside the cylinder can be built up appropriately.

In order to ensure appropriate compression in the piston surface cavity, it is provided that the tensioning piston comprises a plate-shaped recess on the head side. This plate-shaped recess ensures that the pressure fluid or the pressure-transmitting fluid can spread evenly across the largest possible surface of the piston. It also prevents the tensioning piston from practically sticking to the rod head. Overall, this arrangement ensures a fast, reliable response of the corresponding pressure increase system.

It had already been pointed out further above that the tensioning piston has a significantly larger diameter than the associated small piston rod. In particular, the piston rod has a diameter of 68 mm, and the tensioning piston has a diameter of 110 mm. The piston surface cavity by contrast has a diameter of 70 mm, which will be addressed hereinafter.

In accordance with the dimensions mentioned above, a selectively annular gap remains, wherein the invention provides that the small piston rod is designed such that an annular gap remains between it and the borehole wall of the piston, which is connected to the bottom of the bushing bottom through which the small piston rod can travel. This way, when inserting the small piston rod in the borehole, pressure fluid is displaced through the annular gap, ensuring that appropriate pressure is applied to the bushing bottom so that this rod is displaced in the longitudinal direction of the cylinder, carrying the rod head with it.

An appropriate further refinement provides that the bushing bottom has a stepped design, wherein the lower small step comprises effective sealing rings in relation to the outer wall of the small piston rod and the inner wall of the large piston rod. While initially this offers only a small surface for the additionally compressed pressure transducer, this surface increases as the bushing is lifted out of the second seat so that the second step then becomes effective.

On the basis of the dimensions indicated above, but also on the basis of the basic effect, it is apparent that the tensioning piston has a larger diameter than the small piston rod, thus forming in the bushing an air ring cavity that contains air. When inserting the tensioning piston and the small piston rod, the air contained therein must be displaceable, which is accomplished in that the bushing in the area of the bushing bottom comprises a cross borehole, connecting the air ring cavity between the bushing inside wall and the outside wall of the small piston rod with a longitudinal borehole to the outside atmosphere. When retracting the tensioning piston and the small piston rod, the air is thus pushed into the longitudinal borehole without difficulty via the cross-hole, and from there it can be discharged to the outside atmosphere. With the reversed process, air will enter the air ring cavity via the outside atmosphere and the longitudinal borehole as well as the cross-hole, so that the tensioning piston and the small piston rod can be pushed safely back into the initial position.

Pressure transducer or hydraulic fluid is applied to the large piston from beneath for the purpose of retracting the cylinder. This is accomplished especially expediently in that between the inside wall of the cylinder housing and the outside wall of the large piston rod an annular cavity is formed, which is closed towards the bottom by the piston with the sealing rings and towards the top by a clamp collar with integrated sealing rings, which can be connected to the same high pressure pump via a leveling valve. Thus, if the connection to the high pressure pump is established via the leveling valve, the pressure transducer directly enters the annular cavity, during which process the sealing rings ensure that the annular cavity is sealed to the outside. In this way, the pressure transducer affects exclusively the bottom of the large piston, so that said piston is moved back into the starting position.

In order to be able to position the clamp collar securely, it is provided that the clamp collar has available an outside thread, which is designed such that it corresponds to the inside thread associated with the cylinder housing end. The clamp collar can then be screwed in and assumes a secure position, even if the cylinder is being moved out or retracted.

Despite the relatively high pressure building up on the inside of the cylinder, it is sufficient if the sealing rings allocated to the clamp collar are arranged in a sealing fashion in relation to the large piston rod and the annular cavity. It is useful if the clamp collar comprises two sealing rings as well as a third one that is directed downward, i.e. in the direction of the annular cavity.

The invention is especially distinguished in that a method and a device are created which basically simplify the operation of cylinders. Operation may occur either with pumps of low output, whereby then the required pressure increase is performed in the cylinder, or one can operate with the same units, especially the high pressure pumps generating the highest pressure and can then generate a considerably higher pressure beyond this inside the cylinder, which either offers an increased travel or increased pressure within the cylinder. Overall, the method and device offer specialists the opportunity to simplify existing hydraulic systems or compressed air systems, managing with less expensive hoses having thinner walls, and possibly also with corresponding cylinders, or also to create such a high pressure level that this way the above-described advantages can be achieved, using existing hoses.

BRIEF DESCRIPTION OF THE DRAWINGS

Further details and advantages of the object of the invention result from the following description of the corresponding drawing, which illustrates a preferred embodiment including the necessary details and individual parts, wherein.

DETAILED DESCRIPTION OF THE PREFERRED EMBODIMENTS

Figure 1:
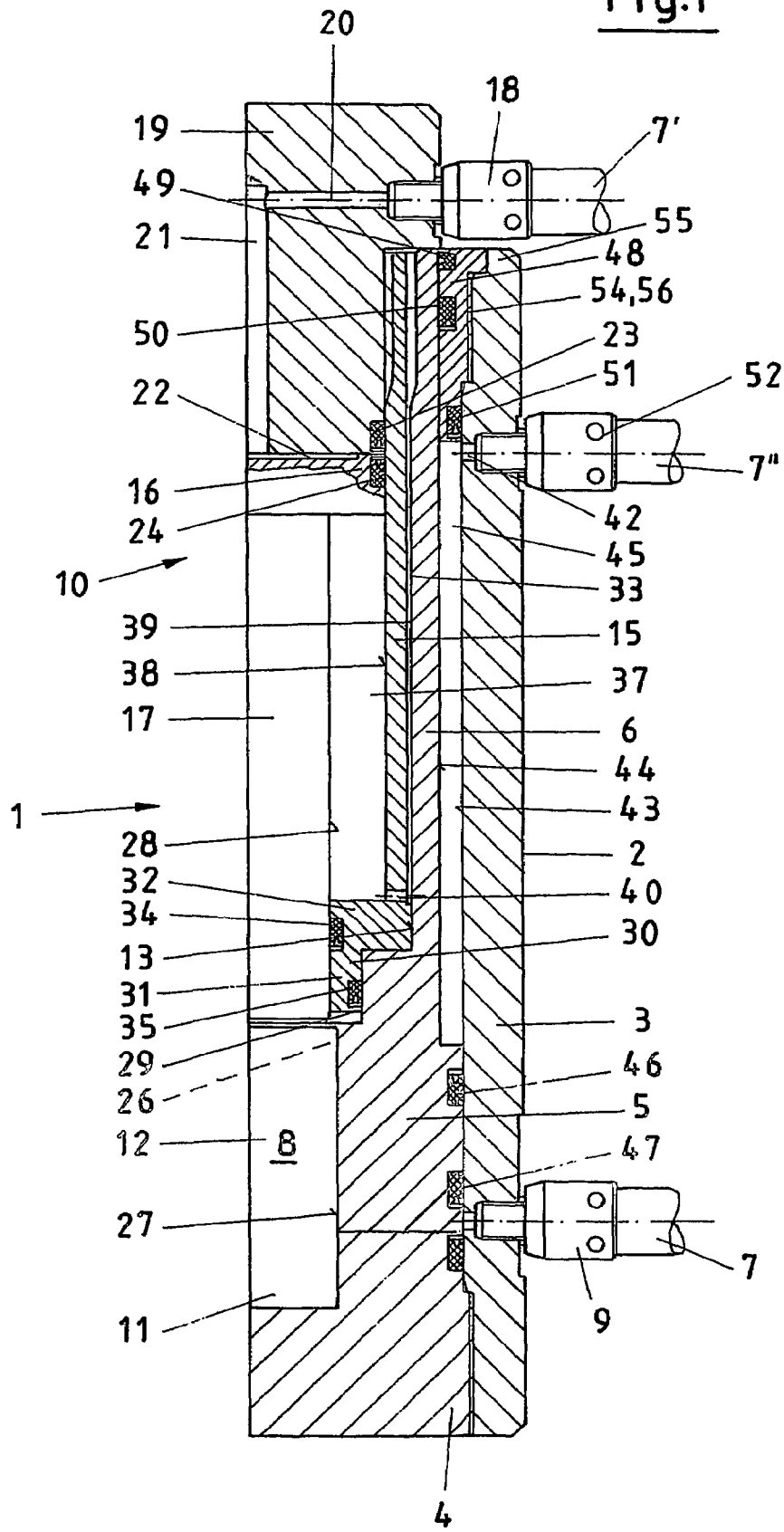
FIG. 1 is a longitudinal section through a cylinder with a pressure increase system.

FIG. 1 shows a cylinder 1 in the longitudinal section, whereby it becomes clear that the foundation 2 of this cylinder 1 comprises a cylinder housing 3 with a cylinder cover 4 and a piston 5 with a piston rod 6. The piston 5 with the piston rod 6 is arranged displaceably inside the cylinder housing 3, with the supply line 7 feeding hydraulic fluid or pressure transducer into a piston surface cavity 8 via an input valve 9. This pressure transducer penetrating into the piston surface cavity 8 ensures that the piston 5 with the piston rod 6 and the rod head 19 at the end travels out of the cylinder housing 3. The inside, here referred to as a compressor 10, does not impair this movement and/or supports it.

The piston surface cavity 8 in the illustrated example is formed by the borehole 11 in the cylinder cover 4, the borehole 12 in the piston 5 and the borehole 13 in the piston rod 6. The piston surface cavity 8 hence has the shape of a cylinder.

The large piston rod 6 is hollow, as already mentioned, with the borehole 13 extending all the way to the upper end. A bushing 15 is arranged in this borehole 13, which holds a tensioning piston 16 with the small piston rod 17. The tensioning piston 16 is arranged displaceably in the longitudinal direction, wherein it can be connected to the supply line 7' and the high pressure pump, which is not shown here, via a connecting valve 18 attached to the rod head 19 and the connecting boreholes 20, 21. The pressure transducer is hence conducted from the supply line 7 into the connecting valve 18 and from there via the two connecting boreholes 20, 21 to the tensioning piston 16, which in this area comprises a plate-shaped recess 22. In this way, it is ensured that the inflowing hydraulic fluid, i.e. the pressure transducer, can apply pressure on the entire surface of the tensioning piston 16. Seals 23, 24 are disposed on the edge of the tensioning piston 15, which ensure the necessary sealing effect and guarantee that the pressure transducer can apply pressure on the tensioning piston 16 all the way to the bushing 15. The correspondingly large diameter of the tensioning piston 16 then ensures that in the case of an appropriate load applied by the typical pressure transducer, i.e. the typical pressure level of the pressure transducer, the tensioning piston 16 and the small piston rod 17 can be pushed forward in the direction of the piston surface cavity 8. In doing so, the small piston rod 17 displaces the pressure transducer present in the piston surface cavity 8 and/or compresses it. Only when an additionally increased pressure exists in the piston surface cavity 8 will the hydraulic fluid or pressure-transmitting fluid also apply pressure on the bottom 29 of the bushing borehole 30 via the annular gap 26 between the borehole wall 27 of the piston 5 and the outside wall 28 of the small piston rod 17. This effect or influence increases further if the bushing 15 due to the pressure conditions has moved along with the rod head 19 because the bushing bottom 30 comprises two steps 31, 32. Sealing rings 34, 35 are arranged in the bushing bottom 30 such that for one they seal the configuration against the inside wall 33 of the large piston rod 6, and secondly against the outside wall 28 of the small piston rod 17.

It is recognizable in FIG. 1 that due to the different dimensions of the tensioning piston 16 and the small piston rod 17, an annular air space 37 remains between the latter and the bushing inside wall 38, this space being connected via a cross-hole 40 to a longitudinal borehole 39, which leads in the direction of the atmosphere because it exits the bushing 15 at its end. This offers the possibility that air can escape from the air ring cavity 37 through the cross-hole 40 and the longitudinal borehole 39 when retracting the tensioning piston 16. Conversely, it can penetrate again into the air ring cavity 37 the opposite way, i.e. through the longitudinal borehole 39 and the cross-hole 40 when sliding the tensioning piston 16 with the small piston rod 17 back.

An annular space 45 is provided between the inside wall 43 of the cylinder housing 3 and the outside wall 44 of the large piston rod 6 for the purpose of retracting the piston 5 with the large piston rod 6. This annular space 45 extends to beneath the piston 5. The annular space 45 is connected via a cross-hole 42 to the retracting valve 52 so that pressure transducer may be fed into this annular space 45 via the supply line 7", if needed. This ensures that the piston 5 with the large piston rod 6 is pushed back into the starting position illustrated in FIG. 1 due to the pressure relief in the area of the input valve 9. In order to ensure the effect of the pressure, transducer seal rings 46, 47 are provided in the piston 5, which on one hand are supposed to provide a seal against the annular space 45 and on the other hand against the input valve 9.

The annular space 45 is connected to the cylinder housing end 55 via a clamp collar 48, which is equipped with several sealing rings 49, 50, 51 so as to provide a seal in relation to all sides. It comprises an outside thread 54, which is designed to correspond to the inside thread 56 of the cylinder housing end 55, enabling it to be screwed in.

Figure 2:
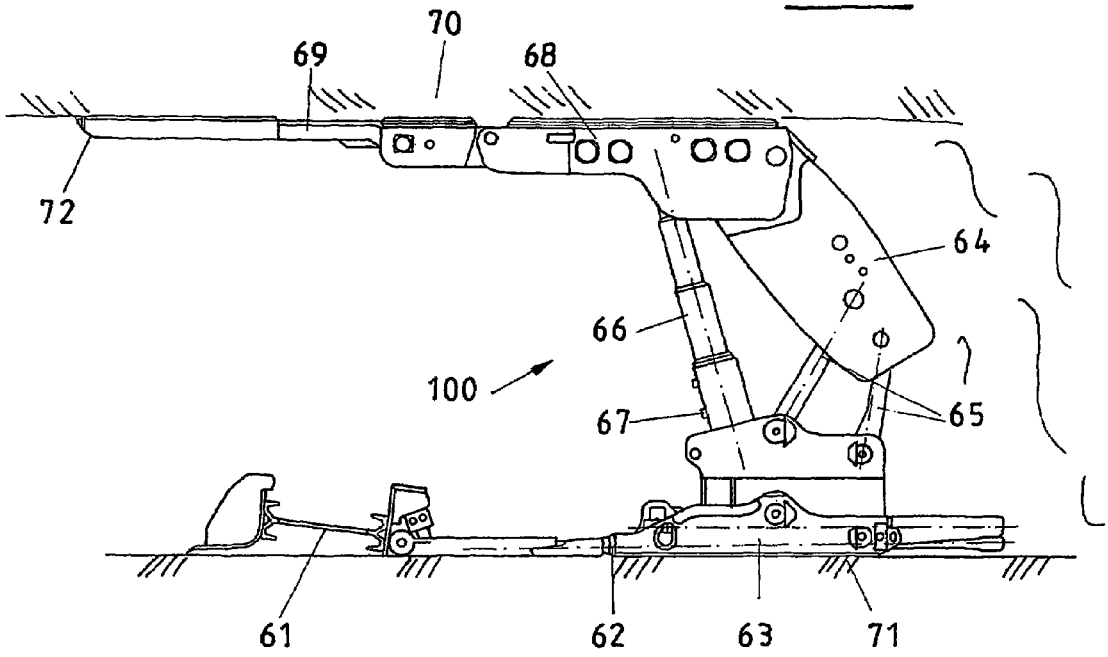
FIG. 2 is a shield-type support comprising several cylinders, to be used in underground mining.

FIG. 2 shows a shield-type support 60, comprising several cylinders described below. Especially in underground mining and tunnel construction, a safety standard is achieved using a water-in-oil hydraulic system which is excellent in terms of the employed fluid as well as the achievable input pressure. The goods are transported away by means of the conveying equipment 61, wherein this conveying equipment 61 extends in the direction of the background and vice versa and is connected to the base plate 63 of the shield-type support via a push cylinder 62. The conveying equipment 61 is constantly influenced by means of the shifting jack 62 that is rests closely against the coal face, which is not shown here. Extending from the base plate 63, the shield 64 is connected to several lemniscate arms 65 so as to be able to assume an optimal position to the footwall at all times. The stamp or stamps 66, in this case a multi-part stamp, are supplied with hydraulic fluid of about 360-400 bar via a supply line running through the longwall. These stamps 66, as is explained more below, are connected directly and indirectly to the high pressure pump via the connecting valve 67. However, only one supply line is required for this, which in particular can have a simplified design when the cylinder, i.e. the stamp 66 and also the remaining cylinders are designed as illustrated in FIG. 1. The shield 64 is followed by the hanging wall cap 68, which is supported by the stamp 66. The front part of this hanging wall cap 68 is formed by the sliding part 69, which can likewise be inserted and displaced using a cylinder, which is not illustrated here, in order to bring the tip 72 of the hanging wall cap 68 as close as possible to the coal face. Such a longwall construction extends between the hanging wall 70 and footwall 71 and ensures that the space remains open as long as is required for extraction.

Figure 3:
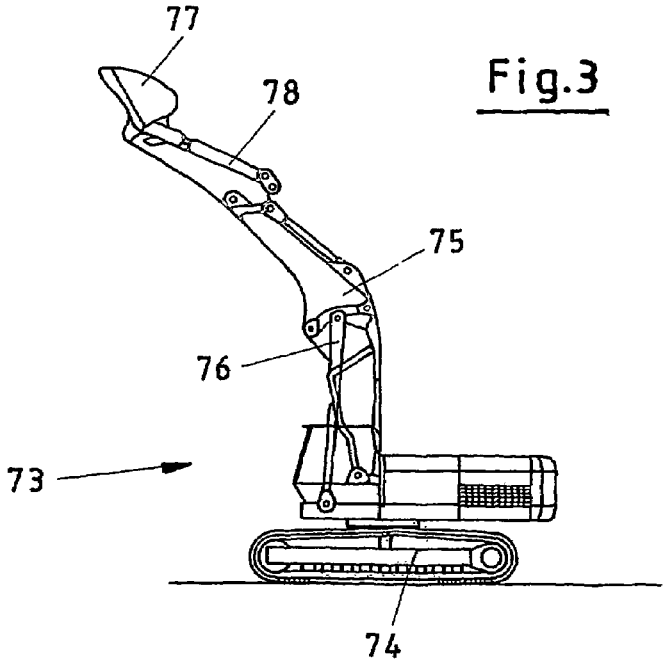
FIG. 3 is an excavator, which likewise comprises several cylinders.

FIG. 3 shows in a simplified form a hydraulic excavator 73 with its traveling part 74 and the swivel arm 75. Cylinders are allocated to the swivel arm 75, however, as well as to the bucket 77 and other components which allow the individual functions to be performed or facilitated. Using the adjusting cylinder 76, the lower part of the swivel arm 75 is swiveled up or brought into a different position, while the bucket 77 is controlled in its movements via the bucket cylinder 78. Both with such hydraulic excavators 73 and with longwall construction 60 the use of the present invention is particularly interesting because a plurality of cylinders is employed, which also have other functions. Therefore it is not absolutely necessary to equip all cylinders with an interior compressor.

All aforementioned features which can be inferred solely from the drawings are considered essentially for the invention alone and in combination.

The invention claimed is:

1. Method for increasing pressure in cylinders used for oil hydraulic, water hydraulic, or emulsion hydraulic systems as well as plasma or other fluid hydraulic systems, in which two part or multi-pan cylinders, which comprise a foundation and, arranged displaceably therein, a first piston with a first piston rod, are moved apart or together in a controlled fashion by means of valves and the pressure-transmitting medium which is introduced, having passed through a high pressure pump, with a specified pressure being generated and maintained in the piston surface cavity beneath the first piston, even after extension of the first piston, by means of compressing the piston surface cavity, wherein the cylinder, specifically its piston surface cavity, is initially fed a pressure-transmitting medium of a specified pressure level and the cylinder is hence moved apart, and wherein the pressure in the piston surface cavity beneath the first piston is increased by using the pressure-transmitting medium of a specified pressure level for compression of the pressure transducer in the piston surface cavity in that a different piston with an associated piston rod, which is displaceably arranged in the first piston rod, is inserted in the piston surface cavity with the help of the pressure-transmitting medium having a specified pressure level and the volume of the piston surface cavity is thereby reduced.

2. Cylinder for implementing the method according to claim 1, comprising a foundation (2), which is connected to a high pressure pump via a supply line (7), with a cylinder housing (3) and a piston/piston rod (5, 6) displaceable therein, and the piston surface cavity (8) formed beneath the piston (5) between the cylinder cover (4) and piston (5), piston rod (6) as well as the cylinder housing (3) as well as a compressor (10), which can be inserted in the piston surface cavity (8), wherein the compressor (10) is designed as a tensioning piston (16) with a small piston rod (17), is arranged displaceably within the piston surface cavity (8) serving as the compressor and can be connected on the head side of the tensioning piston (16) with a pressure-pressure pump.

3. Cylinder according to claim 2, characterized in that the piston surface cavity (8) is designed as a borehole (11, 12, 13) incorporated in the cylinder cover (4), piston (5) and piston rod (6), with the borehole (13) in the piston rod (6) being expanded such that it accommodates a bushing (15), in which the tensioning piston (16) with a smaller piston rod (17) corresponding in its diameter to the borehole (ii, 12, 13) is arranged displaceably.

4. Cylinder according to claim 3, characterized in that the bushing (15) accommodating the tensioning piston (16) is closed by a rod head (19), which at the same time also closes the large piston rod (6X which are allocated connecting boreholes (20, 21) linking the connecting valve (18) and tensioning piston (16) on the head side being allocated to the rod head.

5. Cylinder according to claim 2, characterized in that the piston surface cavity (8) can be connected directly to the high pressure pump via the input valve (9) arranged on the head side of the piston (5).

6. Cylinder according to claim 2, characterized in that the tensioning piston (16) comprises a plate-shaped recess (22) on the head side.

7. Cylinder according to claim 2, characterized in that the tensioning piston (16) has a clearly larger diameter compared to the allocated small piston rod (17).

8. Cylinder according to claim 2, characterized in that the small piston rod (17) is designed such that an annular gap (26) is formed between it and a borehole wall (27) of the piston (5), said gap being connected to the bottom (29) of a bushing bottom (30) though which the small piston rod (17) can travel.

9. Cylinder according to claim 8, characterized in that the bushing bottom (30) has a stepped design, with the lower smaller step (31) comprising effective sealing rings (34, 35) towards the outside wall (28) of the small piston rod (17) and the inside wall (33) of the large piston rod (6).

10. Cylinder according to claim 2, characterized in that the bushing (15) in the area of the bushing bottom (30) comprises a cross-hole (40) connecting the air ring cavity (37) between the bushing inside wall (38) and outside wall (28) of the small piston rod (17) with a longitudinal borehole (39) to the outside atmosphere.

11. Cylinder according to claim 2, characterized in that between the inside wall (43) of the cylinder housing (3) and the outside wall (44) of the large piston rod (6) an annular cavity (45) is formed, which is closed towards the bottom by the piston (5) with sealing rings (46, 47) and to the top with a clamp collar (48) with integrated sealing rings (49, 50, 51), which can be connected to the same high pressure pump via a leveling valve (52).

12. Cylinder according to claim 11, characterized in that the clamp collar (48) comprises an outside thread, which is designed to correspond to an inside thread (56) allocated to the cylinder housing end (55).

13. Cylinder according to claim 11, characterized in that the sealing rings (49, 50, 51) associated with the clamp collar (48) are designed in a sealing fashion towards the large piston rod (6) and towards the annular cavity (45).

* * * * *